US005941178A

United States Patent [19]

Kohlhaas

[11] Patent Number: 5,941,178

[45] **Date of Patent: *Aug. 24, 1999**

[54] NESTABLE PALLET ASSEMBLY

[76] Inventor: Frank A. Kohlhaas, 130 Lake Julia Dr. North, Ponte Vedra Beach, Fla. 32082

[ * ] Notice: This patent is subject to a terminal disclaimer.

[21] Appl. No.: 09/017,909

[22] Filed: Feb. 3, 1998

Related U.S. Application Data

[62] Division of application No. 08/840,321, Apr. 16, 1997, Pat. No. 5,730,067, which is a continuation of application No. 08/658,802, Jun. 7, 1996, abandoned.

[51] Int. Cl.[6] ..... B65D 19/12

[52] U.S. Cl. ..... 108/56.3; 108/51.3; 108/53.3

[58] Field of Search ..... 108/56.3, 51.11, 108/56.1, 53.3, 51.3

[56] References Cited

U.S. PATENT DOCUMENTS

| | | | |
|---|---|---|---|
| 3,598,065 | 8/1971 | Young | 108/56.3 X |
| 3,610,172 | 10/1971 | Wharton | 108/56.3 |
| 3,804,032 | 4/1974 | Baucom | 108/56.3 |
| 4,425,852 | 1/1984 | Riviere | 108/56.3 |
| 4,671,188 | 6/1987 | Betro et al. | 108/56.3 |
| 5,513,577 | 5/1996 | Weis | 108/56.3 |
| 5,730,067 | 3/1998 | Kohlhaas | 108/56.3 |

FOREIGN PATENT DOCUMENTS

| | | | |
|---|---|---|---|
| 2302248 | 9/1976 | France | 108/56.3 |
| 3521830 | 1/1987 | Germany | 108/56.3 |

*Primary Examiner*—Jose V. Chen
*Attorney, Agent, or Firm*—Thomas C. Saitta

[57] ABSTRACT

A pallet assembly comprising an apertured single deck member with a number of leg members configured as hollow truncated cones, the pallet being readily assembled and disassembled. The legs include a peripheral flange to support the deck member and a number of vertically extending locking tabs with engagement lips adapted to either seat on the upper surface of the deck or be embedded into the interior of the deck to secure the leg to the deck. An annular locking ring is positioned in the interior of the leg to force the locking tabs outwardly against the deck. The pallets may be nested in a vertical stack.

18 Claims, 3 Drawing Sheets

NESTABLE PALLET ASSEMBLY

This application is a divisional application of U.S. patent application Ser. No. 08/840,321, filed Apr. 16, 1997, now U.S. Pat. No. 5,730,067, which is a continuation of U.S. patent application Ser. No. 08/658,802, filed Jun. 7, 1996, now abandoned.

BACKGROUND OF THE INVENTION

This invention relates generally to pallets constructed for use with fork lifts or hand trucks, the pallets comprising one or two generally horizontal deck members with multiple discrete support columns or legs maintaining the upper deck member a sufficient distance above the ground or above the bottom deck member to allow for easy insertion of the lifting tines of fork lifts or hand trucks. More particularly, the invention relates to single-deck pallets having multiple legs which are easily disassembled and assembled from the deck member, and where the pallets are nestable in a vertical manner when empty, such that storage and transportation is more efficient. Even more particularly, the invention relates to pallet assemblies in which the leg members comprise two separate components to insure secure engagement with the deck member.

Pallets having single deck members for supporting other items for storage or transport with multiple individual leg members to raise the deck member sufficient distance from the ground to allow access for fork lifts or hand trucks in order to move the pallet are well known in the industry. The pallets must be constructed with suitable strength and durability characteristics, as they are routinely subjected to relatively rough handling and treatment. It is often advantageous to provide a pallet assembly where the legs can be removed from the deck member, such that the pallet assembly can be disassembled and reassembled when desired. The ability to disassemble the pallet may be useful for transporting or storing large numbers of empty pallets, as well as allowing for replacement of individual components, either the legs or the deck members, which become damaged in use. It is also useful if the pallets are constructed such that they are nestable, the legs of one pallet fitting into the interior of the legs of a pallet beneath it, such that the deck of the upper pallet will rest on or close to the deck of the lower pallet. This allows fully assembled pallets to be stored and transported efficiently since a large number of pallets can be stacked so as to occupy minimal total volume.

Pallets which are nestable, which easily disassemble when desired, and which have multiple component leg member structures are known. For example, Wharton in U.S. Pat. No. 3,610,172 shows a multiple component leg construction for use with dual deck pallets. Baucom in U.S. Pat. No. 3,804,032 teaches a single deck member with nestable legs which easily disassemble and reassemble. The legs are single piece members with dual flanges for gripping the deck member. The deck apertures are cut with tabs or slots which allow the leg members to be inserted onto the deck member by twisting or sliding. This construction does not provide a very secure engagement between the legs and deck, and is only useful for pallets with decks constructed of a compressible paperboard material such as corrugated cardboard. Wies et al. in U.S. Pat. No. 3,915,099 discloses a pallet construction which could be used for single deck, nestable leg pallets. This patent shows a single piece leg member which is designed to grip the deck member between a lower annular flange and upper horizontal tab members. As in Baucom, the circular pallet apertures to receive the legs are provided with cutouts which correspond to the positions of the horizontal tabs on the leg, such that the leg member is inserted so that the tabs pass through the cutouts, and the leg is then rotated to grip the deck member. Again the deck must be compressible, so that again the pallet is not securely constructed. Riviere in U.S. Pat. No. 4,425,852 teaches a two part leg construction for use with single decks. The legs are nestable and easily assembled, but are not designed to disassemble. The Riviere leg has a hollow, truncated cone configuration with an annular flange to engage the upper side of the deck member and several annular locking shoulders positioned at a point beneath the bottom of the deck. A locking ring is placed onto the leg from the underside and pushed upward to compress the deck member and position its bottom rim above the locking shoulder. Morder in U.S. Pat. No. 5,193,464 shows a tabbed leg member similar to the device of Wies et al., such that cutouts are required in the leg apertures for insertion of the leg, this leg having an inverted truncated cone in the center of the leg to provide a support surface interior to the leg opening.

It is an object of this invention to provide a pallet assembly comprising a single deck member for supporting objects and a number of leg members to raise the deck a suitable height from the floor to allow for insertion of fork truck or hand truck tines, which is easily assembled and disassembled, which allows multiple pallets to be stacked in a nesting manner whereby the least amount of space is occupied by the stacked pallets, and which provides an extremely, strong, sturdy and durable pallet assembly resistant to damage from compressive and shearing forces. It is a further object to provide such a pallet assembly which can be utilized with non-compressible deck members such as plywood, and wherein the leg members may be easily fabricated from metal or plastic.

SUMMARY OF THE INVENTION

Figure 1:
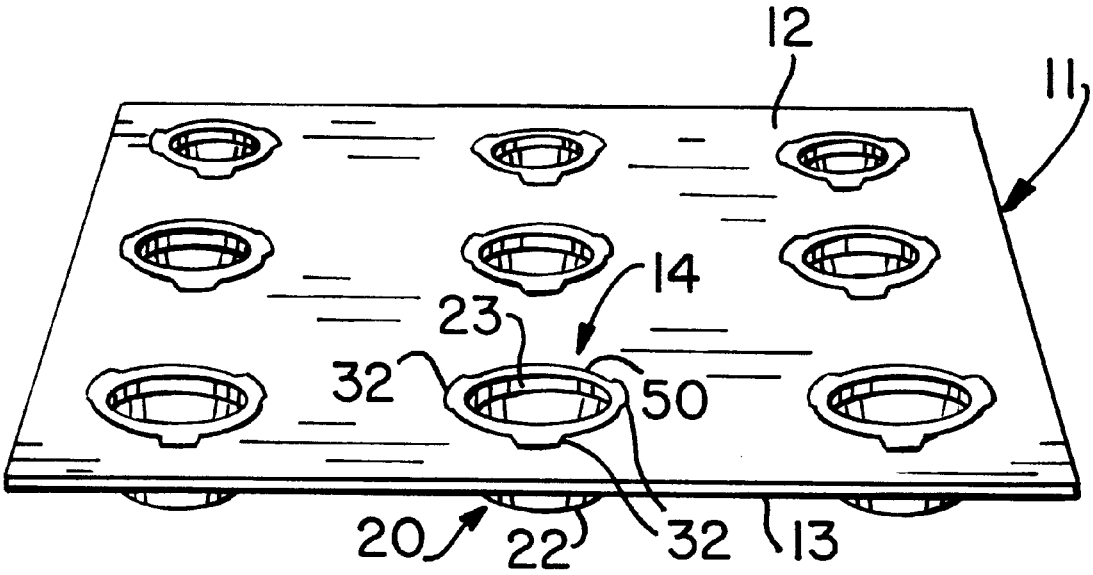
FIG. 1 is a perspective view of the pallet assembly of the invention.

The invention is a pallet assembly comprising a single deck member and multiple legs attached to said deck member. The deck member may be composed of any suitably durable and strong material, including paperboard, corrugated cardboard, plywood, wood or like material, and is preferably composed of plywood of sufficient thickness to prevent excessive flex. A number of circular apertures adapted to receive the leg members are positioned in the deck member so as to allow unimpeded access lanes for insertion of fork lift or hand truck tines between the leg members in order to transport the pallet assembly. The leg members are of sufficient height to support the deck member in a horizontal position the required distance from the floor to allow access by the fork lift or hand truck.

The legs members are composed of any suitably strong and durable material capable of supporting the weight of a loaded pallet, such as steel sheet metal or a high strength plastic such as PVC. The legs are preferably configured in a general truncated cone shape, although other cross-sectional shapes such as square, hexagonal, etc., are possible, with the diameter of the bottom or base of the leg being smaller than the diameter across the open top of the leg, such that the side wall slopes inwardly. The interior of each leg is designed such that another leg may be nested in close proximity within its open interior. A peripheral deck support flange extends radially outward from the side wall of the leg member, providing a horizontal surface to receive and abut the lower surface of the deck member. Extending upwardly from the side wall are vertical locking tabs, preferably at least three in number, which have radially extending engagement lips. Each engagement lip comprises either a short flange retainer member to clip over the upper surface of the deck member or a blade member adapted to be pressed into the deck member within the aperture. An annular shoulder or rib is positioned on the interior of the leg member at or adjacent the top of the side wall, preferably at the same approximate height as the peripheral flange. An annular locking ring sized to fit securely within the interior of the leg member is positioned against the vertical locking tabs, thereby forcing the locking tabs radially outward against the interior of the deck aperture such that either the flange retaining lip extends over the upper side of the deck member or the blade lip bites into the interior of the deck member to preclude separation of the leg from the deck member. The locking ring is preferably constructed with a bevelled lower edge which centers the ring when it is assembled to the leg member, forces the locking tabs outward, and rests on the annular shoulder within the leg member. In addition to the vertical locking tabs, vertical positioning tabs without engagement lips may be provided extending upwardly from the top of the side walls to further secure the leg member against shear forces. The locking ring forces the positioning tabs radially outward in the same manner as the locking tabs. In a preferred embodiment for leg members constructed of sheet steel or similar deformable material, the vertical tabs and peripheral horizontal support flange are formed from an annular piece of material extending upwardly from the top of the side wall by making vertical slits and bending down certain portions to form the support flange. In this case it is preferred that the support flange utilize approximately half the material with the vertical tabs formed from the remaining half.

DETAILED DESCRIPTION OF THE INVENTION

With reference now to the drawings, the invention will be described with regard to the best mode and preferred embodiment. The invention is in general a pallet assembly comprising a single deck member forming a horizontal support platform for carrying other objects, the deck member having a number of depending leg members to support the deck a distance above the floor or other base surface, the legs being spaced such that there is access for fork lift or hand truck tines for movement of the pallet. The individual leg members are easily attached to or removed from the deck member. The pallet assembly is nestable with other like pallet assemblies such that when stacked vertically the pallets occupy a minimum amount of space.

With particular reference to FIG. 1, the invention is seen to comprise a generally planar pallet deck member 11 with an upper surface 12 and a lower surface 13. The deck member 11 is composed of a strong, durable, rigid material capable of supporting a large weight without excessive flexing, such as heavy paperboard, corrugated cardboard, wood or plywood, with plywood being the preferred material. A number of apertures 14 are positioned at particular locations on the deck 11, the apertures 14 acting to receive leg members 20. The leg members 20 are positioned and are of sufficient height, preferably about three inches, to allow access lanes beneath the deck member 11 for the tines of fork lifts or hand trucks. The legs 20 should be of sufficient number to provide suitable support to the deck 11, and a typical pallet assembly will have nine leg members 20, spaced in equi-distant manner.

Figure 2:
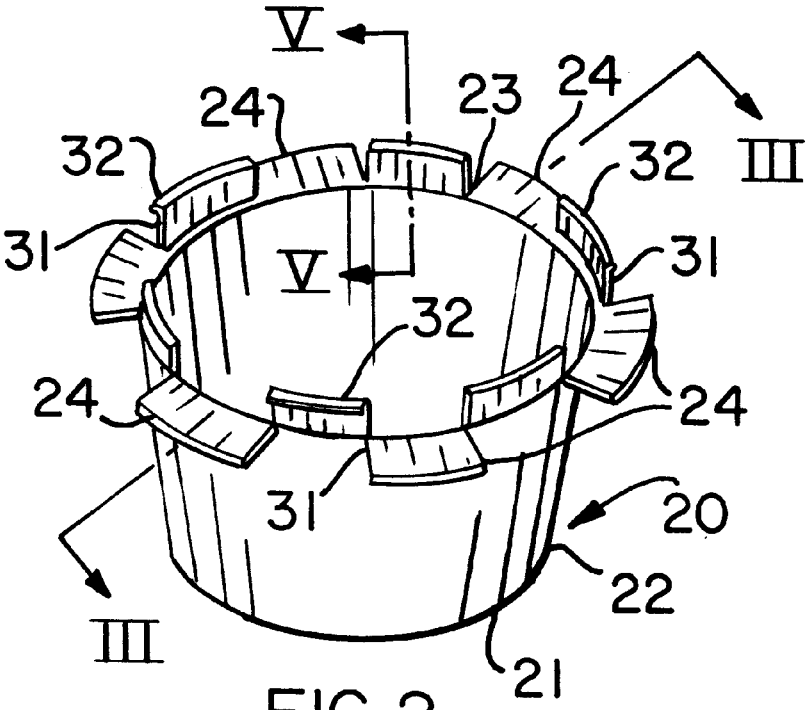
FIG. 2 is a perspective view of the preferred embodiment of the leg members of the invention.
Figure 3:
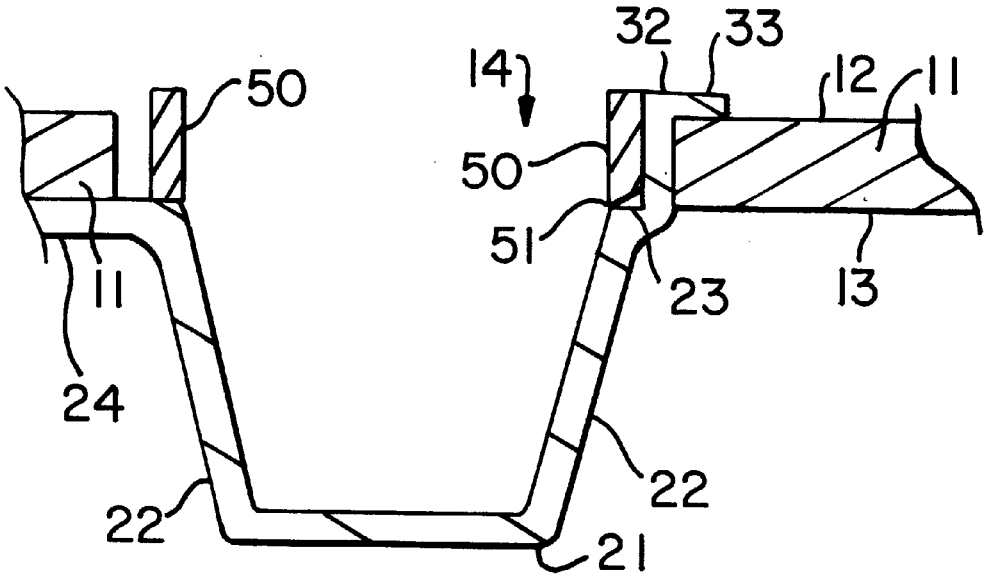
FIG. 3 is a cross-sectional view taken along line III—III of FIG. 2, showing the locking ring in position and the engagement lip of the locking tab formed as a retainer flange on the right side, with a view of the peripheral support flange on the left side.

The structure of the leg members 20 is best illustrated in FIGS. 2 and 3. Leg members 20 may be constructed of any suitable material having sufficient strength and durability properties, for example steel sheet metal or hard plastic such as PVC or the like. The leg members 20 are preferably configured as truncated cones such that the diameter decreases in the downward direction. The legs 20 comprise a generally flat bottom 21, which could be configured to contain reinforcing structures if desired, with a sloping side wall 22 culminating in an annular inner shoulder or rim 23. The interior of the leg 20 is open to allow another leg 20 to be nested within. Extending radially outward from the top of side wall 22 is a peripheral support flange member 24 which provides a generally horizontal support surface to the lower surface 13 of the deck member 11. Support flange member 24 may be segmented, as shown in the preferred embodiment, or may completely circumscribe side wall 22. Support flange member 24 should extend at least one half inch from the side wall 22, and may extend farther if needed for additional support due to the particular material of construction of deck member 11.

Figure 4:
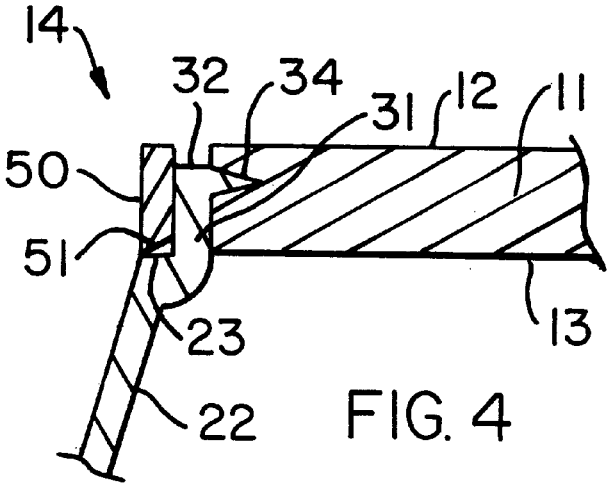
FIG. 4 is a partial cross-sectional view similar to the right side of FIG. 3 showing the engagement lip of the locking tab formed as a blade.

The outer diameter of the top of side wall 22 corresponds to the inner diameter of the deck aperture 14. Extending vertically upward from the top of side wall 22 are locking tab members 31, preferably at least three in number. The locking tab members 31 are preferably positioned equidistant along the circumference of the top of side wall 22. In the preferred embodiment, the locking tabs 31 extend slightly above the upper surface 12 of deck member 11, as shown in FIG. 3. Adjoined to the upper end of the locking tab 31 is engagement lip 32, which in this embodiment comprises a radially extending retainer flange 33. Retainer flange 33 extends a short distance radially, such that when assembled, the retainer flange 33 abuts the upper surface 12 of deck 11, preventing separation of the leg member 20 and deck member 11. In an alternate embodiment shown in FIG. 4, the locking tab 31 is shortened and the engagement lip 32 is formed as a blade member 34 which is embedded into the interior of deck member 11, preferably above the midpoint and most preferably near the upper surface 12. The blade member 34 likewise prevents separation of the leg 20 and deck 11.

Figure 5:
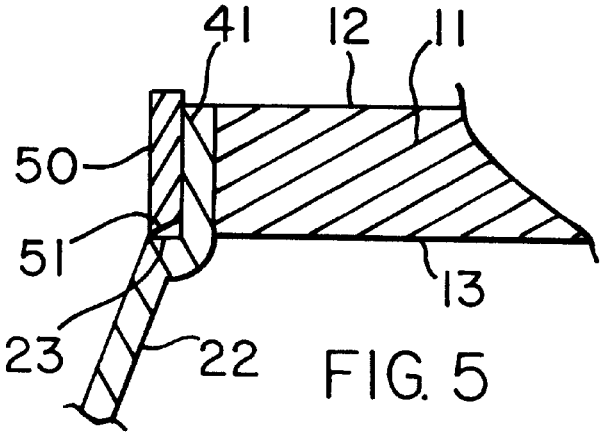
FIG. 5 is a partial cross-sectional view taken along line V—V of FIG. 2, showing the positioning tab and locking ring.

As shown in FIG. 2, the preferred construction of the device comprises a segmented peripheral flange 24 such that the locking tabs 31 and peripheral flange 24 segments may be mechanically formed from the same annular piece of upstanding deformable material, such as sheet steel. In addition to locking tabs 31, the leg member 20 may also be provided with vertically extending positioning tabs 41, shown also in FIG. 5. The positioning tabs provide additional shearing resistance when the legs 20 are attached to the deck member 11, but do not include an engagement lip to retain the deck member 11. Preferably, the vertical locking tabs 31, or the combined locking tabs 31 and positioning tabs 41, occupy approximately 50 percent of the circumference of the side wall 22, such that the peripheral flange 24 also occupies 50 percent of the circumference. This ratio may be adjusted in response to the need to provide additional or reduced load bearing support or additional or reduced shearing resistance.

Figure 7:
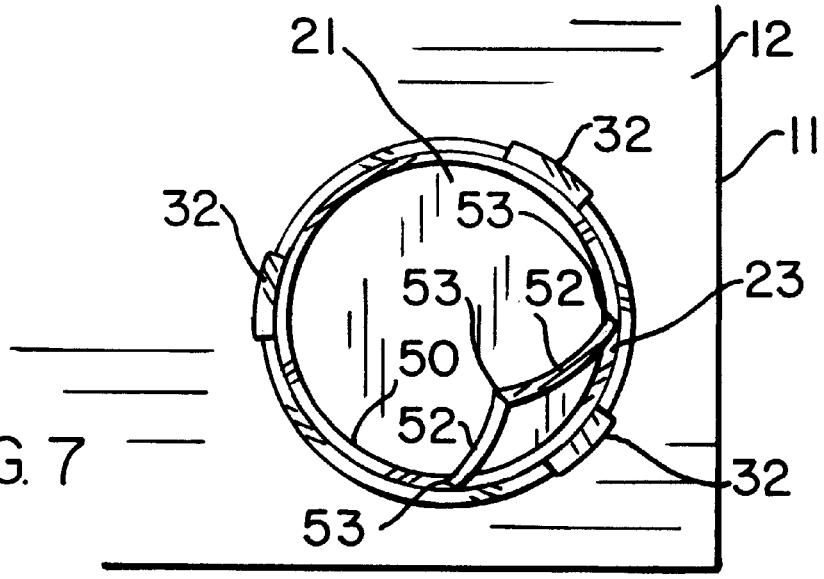
FIG. 7 is a view of an alternative embodiment for the locking ring.

To secure the leg members 20 to the deck member 11, a locking ring member 50 is adapted to be positioned abutting the interior of the locking tabs 31. The locking ring 50 is formed of any strong rigid material, such as metal or hard plastic, which cannot be easily compressed in the inward radial direction. The locking ring 50 is forced into the interior of leg member 20 with its lower edge abutting the internal annular shoulder 23. The locking ring 50 is sized such that its external diameter corresponds to the internal diameter between the vertical locking tab members 31, preferably with no spacing. In this manner the locking ring 50 must be forced into the interior of the leg member 20 to create a friction fit, such that the locking ring 50 cannot be easily removed. When inserted, the locking ring 50 forces the locking tabs 31 outwardly against the walls of aperture 14 in deck member 11 and secures them in position, with either the retaining flange 33 secured over the upper surface 12 or the blade member 34 embedded into the interior of the deck member 11. Preferably, the lower edge of locking ring 50 is a bevelled edge 51. This bevelled edge 51 centers the locking ring 50 and forces the engagement lips 32 of locking tabs 31 outward when the locking ring 50 makes first contact under pressure. The locking ring 50 also forces the positioning tabs 41 against the walls of the deck aperture 14. To remove a leg member 20 after the pallet assembly has been constructed, the locking ring 50 is pried out, thereby allowing the locking tabs 31 to be pressed inward to release the deck member 11. Preferably, locking ring 50 is a short, tubular body, such as formed by cutting off a short section of PVC or metal pipe. Alternatively, locking ring 50 can be of any configuration which provides resistance in the inward radial direction and has a hollow interior to allow nesting of the leg members 20. FIG. 7 illustrates an annular locking ring 50 which is more easily positioned within the leg member 20, the locking ring 50 having two sections 52 joined by flexible junctions 53, such as portions of thin cross-section or hinges. The locking ring 50 is secured in position by pressing outwardly against the middle hinge 53.

Preferably, the engagement lip 32 of the locking tabs 31 is formed with a bevelled or angled upper surface. This prevents the engagement lip 32 from being deformed when the leg member 20 is inserted into the deck aperture 14, since the locking tab 31 will flex slightly inward as the leg 20 is fully inserted. Alternatively, the leg member 20 could be formed with the locking tabs 31 angled slightly inward so that there would be no or minimal contact between the engagement lip 32 and the deck member 11 during the insertion step. The locking ring 50 when pressed into the top of leg member 20 would then force the locking tabs 31 and engagement lips 32 outward to secure the deck member 11.

Figure 6:
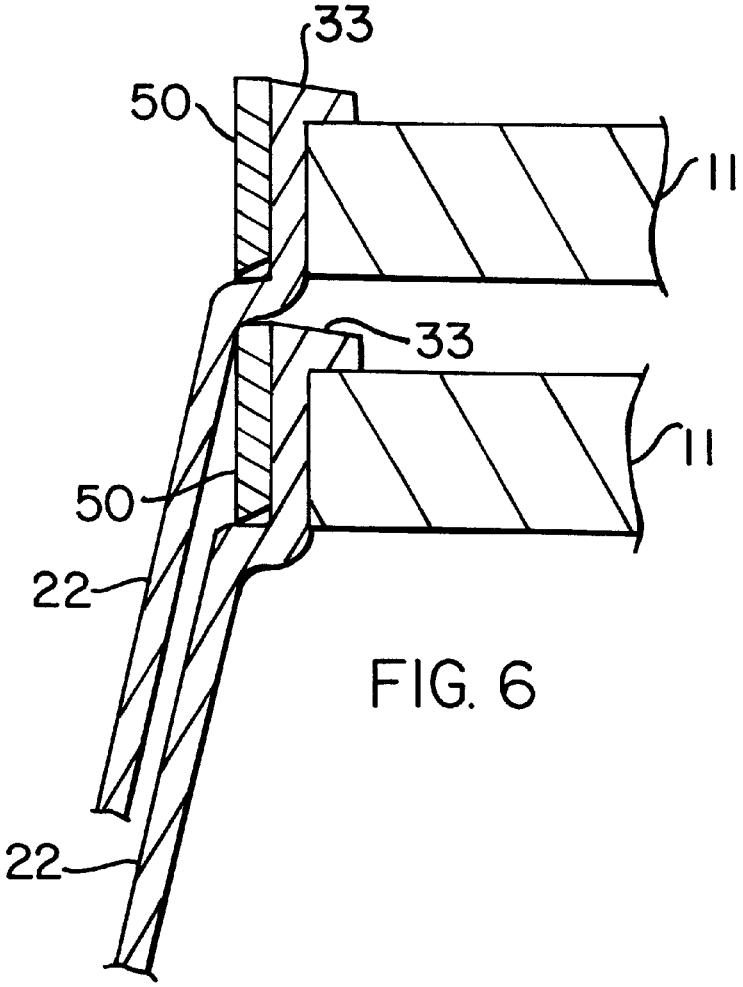
FIG. 6 is a partial cross-sectional view similar to FIG. 3 showing nested pallet assemblies.

As shown in FIG. 6, the invention allows multiple pallet assemblies to be nested for storage or transportation purposes, each leg member 20 fitting within the lower leg member 20 such that the adjacent deck members 11 are only slightly separated or are essentially in direct contact, being separated only by the height of the engagement lip 32 and locking ring 50 extending above the upper surface 12 of each deck 11. For the embodiment where the engagement lip 32 comprises a blade member 34 embedded in the interior of the deck member 11, there will be no portion of leg member 20 extending above the upper surface 12 of deck member 11, and the adjacent decks 11 may stack directly atop one another.

While the preferred configuration for the leg members 20 is circular in cross-section, the invention could be practiced with leg members 20, locking ring 50 and corresponding deck apertures 14 configured in different shapes, such as square, hexagonal, etc., without departing from the intent of the invention. Likewise, the locking tabs 31 and the positioning tabs 41 could be placed adjacent each other, rather than separated as shown in the figures. Other equivalents and substitutions may be apparent to those skilled in the art as well, so therefore the true scope and definition of the invention is to be as set forth in the following claims.

I claim:

1. A nestable pallet assembly comprising a generally planar deck member having an upper surface and a lower surface, and depending leg members connected to said deck member through apertures in said deck member, said leg members each comprising a bottom and side wall joined to form an open interior, a radially extending peripheral flange which abuts the lower surface of said deck member, upwardly extending locking tabs which abut said aperture to secure said leg member to said deck member, annular shoulders positioned at the top of said side walls to support locking rings, and engagement lips extending radially outward from said locking tabs, where said locking tabs are sufficiently flexible and said engagement lips extend a relatively short radial distance whereby said engagement lips cause said locking tabs to flex radially inward when said leg members are inserted directly into said apertures, said locking tabs flexing radially outward to abut said aperture when said leg members are fully inserted, and further comprising locking rings positioned within and abutting said locking tabs to secure said locking tabs to said deck member by forcing said locking tabs radially outward against said aperture and preventing said locking tabs from flexing radially inward.

2. The assembly of claim 1, where said leg members further comprise engagement lips connected to said locking tabs, said engagement lips extending radially outward from said locking tabs.

3. The assembly of claim 2, where said engagement lips abut the upper surface of said deck member.

4. The assembly of claim 2, where said engagement lips comprise blade members which are embedded into said deck member.

5. The assembly of claim 1, where said leg members further comprise annular shoulders positioned at the top of said side walls to support said locking rings.

6. The assembly of claim 1, where said locking rings comprise hinged sections.

7. The assembly of claim 1, where said leg members further comprise upwardly extending positioning tabs.

8. The assembly of claim 1, where said peripheral flange is segmented.

9. The assembly of claim 1, where said leg members are configured as truncated cones.

10. A nestable pallet assembly comprising a generally planar deck member having an upper surface and a lower surface, and depending leg members connected to said deck member through apertures in said deck member, said leg members each comprising a bottom and side wall joined to form an open interior, a radially extending peripheral flange which abuts the lower surface of said deck member, and upwardly extending locking tabs which abut said aperture to secure said leg member to said deck member, and locking rings positioned within and abutting said locking tabs to secure said locking tabs to said deck member by forcing said locking tabs radially outward against said aperture and preventing said locking tabs from flexing radially inward.

11. The assembly of claim 10, where said leg members further comprise engagement lips connected to said locking tabs, said engagement lips extending radially outward from said locking tabs.

12. The assembly of claim 11, where said engagement lips abut the upper surface of said deck member.

13. The assembly of claim 11, where said engagement lips comprise blade members which are embedded into said deck member.

14. The assembly of claim 10, where said leg members further comprise annular shoulders positioned at the top of said side walls to support said locking rings.

15. The assembly of claim 10, where said locking rings comprise hinged sections.

16. The assembly of claim 10, where said leg members further comprise upwardly extending positioning tabs.

17. The assembly of claim 10, where said peripheral flange is segmented.

18. The assembly of claim 10, where said leg members are configured as truncated cones.

* * * * *